US012168159B2

(12) United States Patent
Neuhaus et al.

(10) Patent No.: US 12,168,159 B2
(45) Date of Patent: Dec. 17, 2024

(54) STRENGTH TRAINING APPARATUS WITH MULTI-CABLE FORCE PRODUCTION

(71) Applicant: Oxefit, Inc., Pensacola, FL (US)

(72) Inventors: Peter Neuhaus, Pensacola Beach, FL (US); Jeremy Gines, Pensacola, FL (US); Tyson Cobb, Pensacola, FL (US); Travis Craig, Pensacola, FL (US)

(73) Assignee: Oxefit, Inc., Plano, TX (US)

( * ) Notice: Subject to any disclaimer, the term of this patent is extended or adjusted under 35 U.S.C. 154(b) by 212 days.

(21) Appl. No.: 17/958,507

(22) Filed: Oct. 3, 2022

(65) Prior Publication Data

US 2023/0028361 A1 Jan. 26, 2023

Related U.S. Application Data

(63) Continuation of application No. 16/909,003, filed on Jun. 23, 2020, now Pat. No. 11,504,570.

(51) Int. Cl.
*A63B 21/00* (2006.01)
*A63B 21/002* (2006.01)
(Continued)

(52) U.S. Cl.
CPC ..... *A63B 21/4001* (2015.10); *A63B 21/002* (2013.01); *A63B 21/0058* (2013.01);
(Continued)

(58) Field of Classification Search
CPC . A63B 21/005; A63B 21/0051; A63B 21/008; A63B 21/0083; A63B 21/00069; A63B 21/00076; A63B 21/00181; A63B 21/002; A63B 21/0023; A63B 21/151; A63B 21/153; A63B 21/154; A63B 21/155; A63B 21/156; A63B 21/1681; A63B 21/4017; A63B 21/4019; A63B 21/4033; A63B 21/4034; A63B 21/4035; A63B 21/4043; A63B 21/4045; A63B 21/4047; A63B 21/4049; A63B 23/03516; A63B 2220/13; A63B 2220/16; A63B 2220/34; A63B 2220/51; A63B 2220/54; A63B 2024/0028; A63B 2024/007; A63B 24/0003; A63B 24/0006
See application file for complete search history.

(56) References Cited

U.S. PATENT DOCUMENTS 4,077,626 A 3/1978 Newman
4,138,106 A 2/1979 Bradley
(Continued)

OTHER PUBLICATIONS

International Search Report and Written Opinion on PCT/US2021/036666 dated Sep. 1, 2021, 10 pages.

*Primary Examiner* — Zachary T Moore
(74) *Attorney, Agent, or Firm* — Foley & Lardner LLP

(57) ABSTRACT

An apparatus includes a first cable, a first motor configured to provide first tension to the first cable, a second cable coupled to the first cable at an end effector, and a second motor configured to provide second tension to the second cable. The first cable and the second cable are routed such that the first tension and the second tension combine to provide a force on the end effector. At least one of the first tension or the second tension is directed at least partially in a downward direction.

20 Claims, 7 Drawing Sheets

Leg Exercises

(51) Int. Cl.
*A63B 21/005* (2006.01)
*A63B 21/22* (2006.01)

(52) U.S. Cl.
CPC ..... *A63B 21/151* (2013.01); *A63B 21/153* (2013.01); *A63B 21/225* (2013.01)

(56) References Cited

U.S. PATENT DOCUMENTS 4,235,439 A 11/1980 De Donno
4,479,647 A 10/1984 Smith
4,607,841 A 8/1986 Gala
5,626,540 A 5/1997 Hall
5,928,117 A 7/1999 Vittone et al.
6,030,321 A 2/2000 Fuentes
6,280,361 B1 * 8/2001 Harvey ..... A63B 24/00 482/4
6,379,287 B1 4/2002 Slawinski et al.
6,612,170 B2 9/2003 Brown
7,462,138 B2 12/2008 Shetty et al.
7,625,320 B2 12/2009 Wehrell
8,088,053 B2 1/2012 Whyatt et al.
8,323,158 B2 12/2012 Keiser
8,556,785 B1 10/2013 Ihli et al.
8,721,507 B2 5/2014 Blancher
9,011,156 B2 4/2015 Hallmark
9,072,933 B1 7/2015 Huster
9,254,409 B2 2/2016 Dalebout et al.
9,498,666 B1 11/2016 Boatwright
9,713,439 B1 * 7/2017 Wu ..... A61B 5/221
9,724,563 B2 8/2017 Schmidt
9,814,920 B1 11/2017 Monterrey
9,873,013 B2 1/2018 Williams
9,901,766 B2 2/2018 Ross
10,029,138 B1 7/2018 Boatwright
10,252,096 B2 4/2019 Durket
10,328,307 B2 * 6/2019 Schmidt ..... A63B 23/1209
10,463,905 B1 11/2019 Smith, Jr.
10,486,015 B2 11/2019 Valente et al.
10,589,140 B2 3/2020 Hayes
10,589,163 B2 3/2020 Orady et al.
10,639,510 B2 5/2020 Agrawal et al.
11,007,398 B2 * 5/2021 Neuhaus ..... A63B 23/03525
11,065,496 B2 7/2021 Leipheimer
11,259,982 B2 * 3/2022 Ognibene ..... A63B 21/065
2004/0192519 A1 9/2004 Slawinski
2005/0032612 A1 2/2005 Keiser
2005/0032613 A1 * 2/2005 Wehrell ..... A63B 21/4007 482/133
2005/0233871 A1 10/2005 Anders et al.
2005/0250626 A1 11/2005 Charnitski
2006/0229167 A1 10/2006 Kram et al.
2006/0252609 A1 11/2006 Abelbeck
2008/0300118 A1 12/2008 Wehrell
2010/0041520 A1 2/2010 Popescu
2010/0048368 A1 2/2010 Donofrio
2011/0306479 A1 12/2011 Pierce et al.
2012/0202656 A1 8/2012 Dorsay
2012/0214651 A1 8/2012 Ross
2013/0184128 A1 7/2013 Towley et al.
2014/0038777 A1 2/2014 Bird
2014/0121071 A1 5/2014 Strom et al.
2014/0194251 A1 7/2014 Reich et al.
2014/0342877 A1 11/2014 Rakhmatullin et al.
2014/0342878 A1 11/2014 Hashish
2015/0246258 A1 9/2015 Hockridge
2016/0008650 A1 * 1/2016 Jue ..... A63B 21/4009 482/54
2016/0114211 A1 4/2016 Schmidt
2016/0250514 A1 9/2016 Gvoich
2017/0027803 A1 * 2/2017 Agrawal ..... A61B 5/1122
2017/0056702 A1 3/2017 Carter
2017/0304680 A1 * 10/2017 Schmidt ..... A63B 24/0062
2018/0001128 A1 1/2018 Norris
2018/0021616 A1 1/2018 Orady et al.
2018/0200562 A1 7/2018 Nesbit et al.
2018/0214729 A1 * 8/2018 Rubin ..... A63B 24/0087
2018/0264306 A1 9/2018 Agrawal et al.
2019/0046830 A1 2/2019 Chiavegato et al.
2019/0076691 A1 3/2019 Smith
2019/0247710 A1 8/2019 Unsworth
2019/0344115 A1 11/2019 Neuhaus et al.
2019/0344123 A1 11/2019 Rubin et al.
2020/0047054 A1 2/2020 Ward et al.
2020/0047055 A1 2/2020 Ward et al.
2020/0139187 A1 5/2020 Kennington
2020/0222266 A1 7/2020 Gordon et al.
2020/0289873 A1 9/2020 Charnitski
2021/0220703 A1 7/2021 Lee

* cited by examiner

Leg Exercises

Arm Exercises

STRENGTH TRAINING APPARATUS WITH MULTI-CABLE FORCE PRODUCTION

CROSS-REFERENCE TO RELATED APPLICATIONS

This application is a continuation of U.S. application Ser. No. 16/909,003, filed Jun. 23, 2020, the entire disclosure of which is incorporated by reference herein.

BACKGROUND

This application relates to exercise and rehabilitation equipment, for example resistance-based strength training equipment. Free weights and cable-based strength training devices are typically only able to provide loads which are static in magnitude (e.g., based on the mass of a free weight or weight stack in a cable machine) and direction (e.g., based on the direction of gravity and/or a single cable) throughout performance of an exercise. However, various physiological benefits can be achieved through strength training under dynamic loads. Accordingly, a strength training apparatus configured to provide dynamic, in magnitude and direction, loads to facilitate an exercise program would be advantageous.

SUMMARY

One implementation of the present disclosure is an apparatus. The apparatus includes a first cable, a first motor configured to provide tension to the first cable, a second cable coupled to the first cable at an end effector, a second motor configured to provide tension to the second cable, a rail, a first rotary member engaging the first cable and defining a location at which the first cable extends from the rail, and a second rotary member engaging the second cable and defining a location at which the second cable extends from the rail. The first rotary member is repositionable along the rail relative to the second rotary member.

Another implementation of the present disclosure is a strength training apparatus. The strength training apparatus includes an end effector configured to be engaged by a user of the system, a plurality of cables extending from the end effector, a plurality of repositionable pulleys engaging the plurality of cables, and a plurality of actuators coupled to the plurality of cables. Each actuator is independently operable to provide variable tension to a corresponding cable of the plurality of cables as a function of an operating setpoint for the actuator. The apparatus also includes a controller configured to determine a force vector to be provided at the end effector, receive data indicative of a real-time geometric arrangement of the plurality of cables based in part on current positions of the repositionable pulleys, generate, based on the data, the operating setpoints for the plurality of actuators estimated to cause the tensions in the plurality of cables to combine to provide the force vector at the end effector, and control the plurality of actuators in accordance with the operating setpoints.

Another implementation relates to a method of varying a dynamic resistive force during a strength training exercise. The method includes receiving a selection of the strength training exercise from a set of available strength training exercises and obtaining exercise logic for the strength training exercise from computer memory. The exercise logic provides instructions for generating a vector that defines the dynamic resistive force provided at an end effector of a strength training apparatus during the strength training exercise. The method includes determining a real-time geometric arrangement of a plurality of cables coupled to the end effector, generating, based on the real-time geometric arrangement of the plurality of cables and the exercise logic, time-varying operating setpoints for a plurality of actuator assemblies coupled to the plurality of cables, and exerting the dynamic resistive force at the end effector by controlling the plurality of actuator assemblies in accordance with the time-varying operating setpoints.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Figure 1:
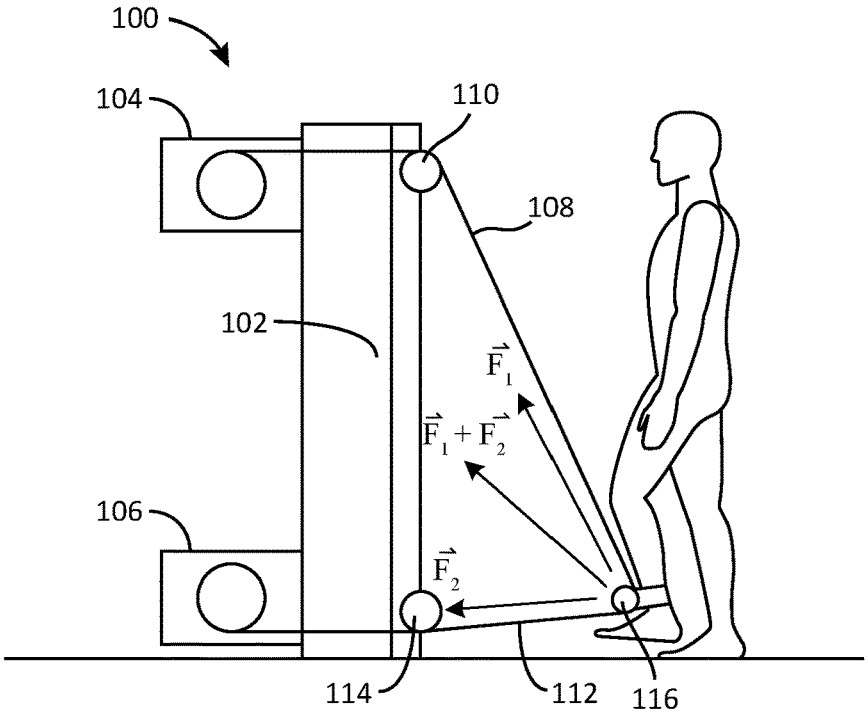
FIG. 1 is an illustration of a dual-cable strength training apparatus providing a leg exercise, accordingly to an exemplary embodiment.
Figure 2:
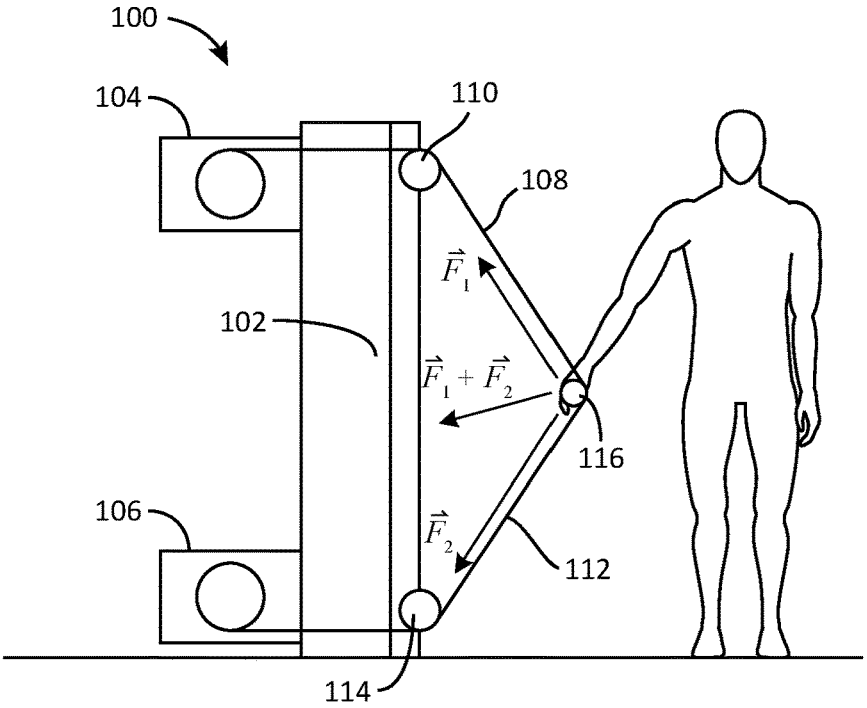
FIG. 2 is an illustration of the dual-cable strength training apparatus of FIG. 1 providing an arm exercise, according to an exemplary embodiment.

Referring now to FIGS. 1-2, side views of a dual-cable strength training apparatus 100 is shown, according to an exemplary embodiment. FIG. 1 shows the dual-cable strength training apparatus 100 being used to provide a leg exercise, i.e., a strength-training exercise for the lower body of a user. FIG. 2 shows the dual-cable strength training apparatus being used to provide an arm exercise, i.e., a strength-training exercise for the upper body of a user. Various full-body or core (e.g., back, glute, abdominal) exercises can also be provided by the dual-cable strength training apparatus 100. As described in detail below, the dual-cable strength training apparatus 100 is highly adaptable to provide dynamic resistive forces to facilitate various strength training exercises targeting any or all of user's muscle groups.

As shown in FIGS. 1-2, the dual-cable strength training apparatus 100 includes a support structure (beam, rail, bar, support, pole, frame, etc.) shown as beam 102, a first actuator assembly 104 positioned at a top end of the beam 102, a first cable 108 extending from the first actuator assembly 104, and a first pulley (ring, wheel, rotating member, etc.) 110 engaged by the first cable 108. The apparatus 100 also includes a second actuator assembly 106 positioned at a bottom end of the beam 102, a second cable 112 extending from the second actuator assembly 106, and a second pulley 114 engaged by the first cable 108. The apparatus 100 also includes an end effector 116 coupled to the first cable 108 and the second cable 112, such that a distal end of the first cable 108 is fixed in position relative to a distal end of the second cable 112 at the end effector 116.

Figure 3:
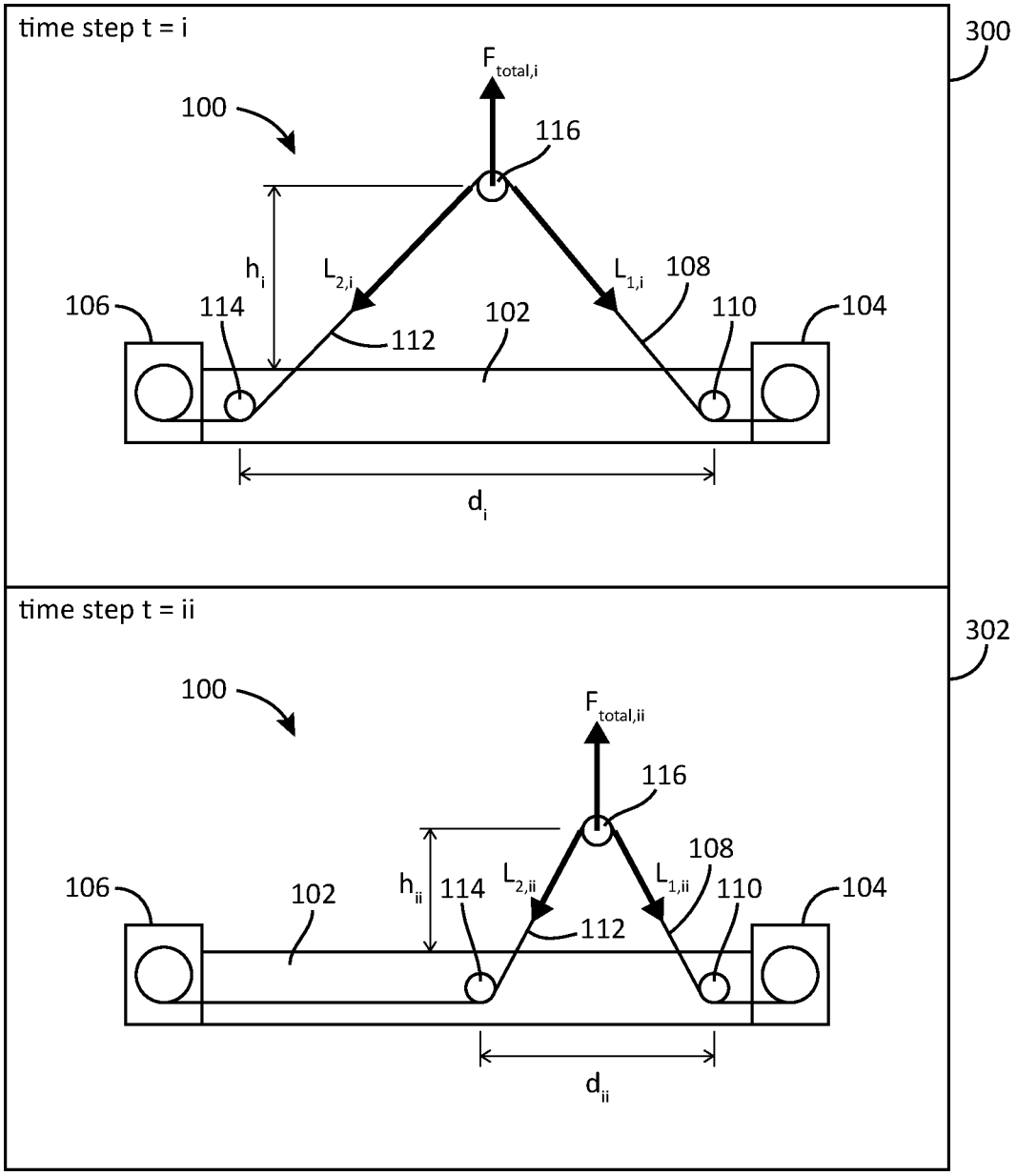
FIG. 3 is an illustration of pulley position adjustment in the dual-cable strength training apparatus of FIG. 1, according to an exemplary embodiment.

In the embodiment of FIGS. 1-2, the beam 102 is oriented vertically and extends perpendicular to a floor of a space that houses the apparatus 100. The beam 102 is preferably fixed such that beam 102 is stable, rigid, and immobile under forces exerted by a user during normal use of the dual-cable strength training apparatus 100. The beam 102 is shown as a substantially linear structure, while in various embodiments has various other structures suitable for rigidly fixing the relative positions between the first actuator assembly 104 and the second actuator assembly 106. In some embodiments, the beam 102 is mounted on or integrated into a wall or other vertical surface of the space. In some embodiments, the beam 102 may be omitted and the actuator assemblies 104, 106 may be independently mounted to a wall. In other embodiments, the apparatus 100 includes a base that supports the beam 102. The base may be affixed (e.g., bolted, etc.) to the floor. The apparatus 100 may include a platform on which the user stands when using the apparatus 100, thereby providing counteracting forces to contribute to stability of the apparatus 100 (see, e.g., FIG. 4). In some embodiments, the beam 102 is provided with a base or mounting structure that allows the beam 102 to be selectively switched between the vertical orientation shown in FIGS. 1-2 and a horizontal orientation (i.e., parallel to the floor/ceiling), for example as shown in FIG. 3, or various angles in between. In the horizontal position, the beam 102 could be mounted at a variety of heights, for example at a floor surface of a space (to enable squat-type exercises), at a position above a user's head (to enable pull-up type exercises), or at some height in between.

The first actuator assembly 104 is configured to provide a tension to the first cable 108. In particular, the first actuator assembly 104 includes a spool (drum, reel, wheel, rotating member, etc.) coupled to a proximal end of the first cable 108 and configured to rotate to wind the first cable 108 onto the spool or unwind to release the first cable 108 from the spool. The first actuator assembly 104 includes an electric motor controllable to generate a torque to cause the spool to wind or unwind the first cable 108. Accordingly, the first actuator assembly 104 is configured to control the amount of the first cable 108 which is either housed on the spool or which extends from the first actuator assembly 104. The torque generated by the first actuator assembly 104 is also configured to provide tension to the first cable 108 between the first actuator assembly 104 and the end effector 116. In particular, the first actuator assembly 104 can be controlled to vary the tension provided along the first cable 108 and, accordingly, a force exerted at the end effector 116 in a direction parallel to the first cable 108.

The second actuator assembly 106 is configured to wind, unwind, and provide a tension to the second cable 112. The second actuator assembly 106 acts on the second cable 112 but is otherwise configured as described for the first actuator assembly 104. Further details regarding the components and control of the first actuator assembly 104 and the second actuator assembly 106 in various embodiments are provided below with reference to at least FIG. 5.

The first pulley 110 and the second pulley 114 are coupled to the beam 102, and may be repositionable along the beam 102 as described in detail below with reference to FIG. 3. The first pulley 110 interacts with the first cable 108 between the first actuator assembly 104 and the end effector 116, and is configured to provide redirection of the first cable 108 relative to the beam 102. The first pulley 110 engages the first cable 108 and rotates to allow translation of the first cable 108 along the pulley 110 (i.e., corresponding winding or unwinding of the first cable 108 from the first actuator assembly 104) and to facilitate changes in orientation of the first cable 108 relative to the beam 102. The first pulley 110 is provided with low-friction bearings which allow the pulley to spin freely about an axis perpendicular to the beam 102. The first pulley 110 may also be mounted on bearings that allow tilting of the first pulley 110 about an axis parallel to the beam 102. In other embodiments, low friction rollers are positioned at either side of the cables 108, 112 where the cables 108, 112 extend from the beam 102, pulleys 110, 114, or actuator assemblies 104, 106 to handle situations where the cables 108, 112 are pulled out of a plane defined by the drums of the actuator assemblies 104, 106. FIG. 1 shows a single first pulley 110 positioned between the first actuator assembly 104 and the end effector 116 to redirect the first cable 108. In other embodiments, additional pulleys are included to facilitate routing of the first cable 108 between the first actuator assembly 104 and the end effector 116 and enabling a wide variety of geometries for placement of the first actuator assembly 104 relative to the beam 102. In yet other embodiments, one or both of the first pulley 110 and the second pulley 114 are omitted, such the first cable 108 exits the first actuator assembly 104 and extends to the end effector 116 without redirection by a pulley and the second cable 112 exits the second actuator assembly 106 and extends to the end effector 116 without redirection by a pulley.

The second pulley 114 interacts with the second cable 112, but is otherwise configured as described for the first pulley 110. FIG. 1 shows a single second pulley 114 positioned between the first actuator assembly 104 and the end effector 116 to redirect the second cable 112. In other embodiments, additional pulleys are included to facilitate routing of the second cable 112 between the second actuator assembly 106 and the end effector 116 and enabling a wide variety of geometries for placement of the second actuator assembly 106 relative to the beam 102.

The first cable 108 and the second cable 112 extend from the beam 102 and form a triangle. The triangle has sides defined by the beam 102, the first cable 108, and the second cable 112. The triangle has vertices defined by the first pulley 110, the second pulley 114, and the end effector 116. The triangle defines a plane which can rotate relative to the beam 102. The position of the end effector 116 has three degrees of freedom, which can be characterized by two-dimensional coordinates in a plane defined by the triangle and a tilt of the plane relative to the beam 102. This geometry and approaches for real-time determination of the geometry are described in further detail below.

In some embodiments, the first cable 108 and the second cable 112 are portions of a continuous cable that extends through, past, along, etc. the end effector 116, with the end effector 116 defining the division between the first cable 108 and the second cable 112. In other embodiments, the first cable 108 and the second cable 112 are provided as distinct/separate elements which are coupled together at their distal ends by the end effector 116. The description herein can refer to either such embodiment.

The end effector 116 is configured to be engaged by a user. In some embodiments, the end effector 116 is formed as a handle, bar, strap, harness, rope, or other attachment configured to be griped by a user, held by a user, attached to a user, or otherwise arranged to exert a force on the user. In other embodiments, the end effector 116 is provided with a mount (e.g., clamp, carabiner) configured to be selectively attached to various end effecter attachments (e.g., handles, bars, hooks, straps, harnesses, ropes, etc.) to provide different interfaces between the user and the apparatus 100 as may be suitable for different exercises. Where the present disclosure describes forces applied at the end effector 116 by the apparatus 100, it should be understood that such forces are counteracted by opposing forces exerted by a user on the end effector, for example as the user performs strength training exercises.

As illustrated in FIGS. 1 and 2, a first force $\vec{F}_1$ is provided at the end effecter 116 by the first cable 108 as a result of the torque provided on the first cable 108 by the first actuator assembly 104. The first force $\vec{F}_1$ has a magnitude defined by the amount of torque provided by the first actuator assembly 104 (and the resulting tension in the first cable 108) and a direction defined by the orientation of the first cable 108 between the end effector 116 and the first pulley 110. A second force $\vec{F}_2$ is provide at the end effector 116 by the second cable 112 as a result of the torque provided on the second cable 112 by the second actuator assembly 106 (and the resulting tension in the second cable 112) and a direction defined by the orientation of the second cable 112 and the second pulley 114. The first force $\vec{F}_1$ and the second force $\vec{F}_2$ combine at the end effector 116 to provide a resulting force vector of $\vec{F}_{total}=\vec{F}_1+\vec{F}_2$ at the end effector 116. The direction and magnitude of the total force vector $\vec{F}_{total}$ experienced by the end effector therefore varies as a function of the geometry of the system and the torques generated by the actuator assemblies 104, 106. Various features for determining the real-time geometry of the system and controlling the torques generated by the actuator assemblies 104, 106 are described in detail below.

Referring now to FIG. 3, a set of drawings depicting the adjustable geometry of the dual-cable strength training apparatus 100 are shown, according to an exemplary embodiment. FIG. 3 includes a first frame 300 that illustrates the dual-cable strength training apparatus 100 having a first geometrical state and a second frame 302 that illustrates the dual-cable strength training apparatus 100 having a second geometrical state. In the embodiment of FIG. 3, the apparatus 100 is shown in a horizontal orientation, with the beam 102 parallel to the floor of space in which the apparatus 100 is used. As mentioned above, the apparatus 100 may be selectively positionable in a vertical or horizontal orientation (or, in some embodiments, at one or more angles in between).

As shown in the first frame 300 (time step t=i), the pulleys 110, 114 are separated by a first distance $d_i$ along the beam 102. In particular, the first distance $d_i$ may describe the distance between the departure points of the cables 108, 112 from the pulleys 110, 114. Because these points change during operation based on the angles at which the cables 108, 112 depart from the pulleys 110, 114, the first distance $d_i$ may understood as distance between axes the pulleys 110, 114 minus a small, dynamic offset calculated based on the radii of the pulleys 110, 114 and the geometry of the cables 108, 112 described in the following paragraphs.

The first distance $d_i$ defines a base of the triangle. One side of the triangle is defined by a length $L_{1,i}$ which corresponds to the length of the first cable 108 between the first pulley 110 and the end effector 116. The remaining side of the triangle is defined by a length $L_{1,i}$ which corresponds to the length of the second cable 112 between the second pulley 114 and the end effector 116. As a result, the triangle has a height $h_i$ in the first frame 300.

As shown in the second frame 302 (time step t=ii), the pulleys 110, 114 have been repositioned to be separated by a second distance $d_{ii}$ along the beam 102 (i.e., a new distance between the departure points of the cables 108, 112 from the pulleys 110, 114). For example, the pulleys 110, 114 can be mounted on carriages which are slidable along the beam 102 to change the distance between the pulleys 110, 114 and the positions of the pulleys along the beam 102. In some embodiments, the positions of pulleys are manually adjustable along the beam 102 between exercises and can be locked into place, for example with a pin lock. As another example, the apparatus 100 includes actuators which are controllable to automatically reposition the pulleys between exercises or, in some embodiments, during exercises to achieve desired geometries for any given exercise. In another example, the actuator assemblies 104, 106 are used in combination with return springs coupled to the pulleys to position the pulleys. To move the first pulley 110 toward one end of its range of the motion, in some such examples, the first cable 108 is tensioned with the motor to provide a force greater than that provided by the return spring. This will move the first pulley 110 to one end of travel (e.g., toward the actuator assembly 104). Once the pulley is in position, a locking system will secure the pulley in this position. To have the pulley move to the other end of travel, the lock is released, and the cable tension is reduced such that the return spring force pushes the pulley to the other end of travel (e.g., away from the actuator assembly). Again, once in position, a lock is engaged to secure the pulley in this new position.

Beneficially, adjustability of the positions of the pulleys can allow the apparatus 100 to optimize tradeoffs between the size of a workspace, maximizing forces perpendicular to the beam 102, and maximizing forces parallel to the beam 102 as needed for different exercises and different users. Different force profiles and effects can be provided by adjusting the positions of the pulleys. The apparatus 100 can include position sensors configured to generate data indicative of the positions of the pulleys 110, 114 along the beam 102.

In other embodiments, for example where the pulleys 110, 114 are omitted, the first actuator assembly 104 and the second actuator assembly 106 may be repositionable relative to one another to change the first distance $d_i$ defining the base of the triangle. For example, the first actuator assembly 104 and the second actuator assembly 106 may be provided on carriages moveable along the beam 102. The first actuator assemblies 104, 106 may be manually repositionable, coupled to actuators configured to automatically reposition the actuator assemblies 104, and/or coupled to return springs and arranged such that operation of the motors of the actuator assemblies 104, 106 in combination with forces applied by the return springs can be used to reposition the actuator assemblies 104, 106. Locking mechanisms (e.g., pin locks, magnetic locks) can be included to fix the actuator assemblies 104, 106 at the desired positions for any given use of the dual-cable apparatus 100.

With the pulleys 110, 114 repositioned to be separated by a second distance $d_{ii}$ along the beam 102 in the second frame 302, a triangle having side lengths of $L_{1,ii}$ (corresponding to the first cable 108 in the second frame 302) and $L_{2,ii}$ (corresponding to the second cable 112 in second frame) is provided. The triangle is shown as having a height of $h_{ii}$ in the second frame 302. By knowing the real-time lengths of all three sides ($d_t$, $L_{1,t}$, $L_{2,t}$) various trigonometric closed-form functions can be applied to calculate approximate values for other dimensions of the real-time geometric arrangement of the apparatus 100. Other approaches, for example numerical iterative techniques that converge on the solution based on the cable payout lengths, can be used to arrive at the real-time geometry in various embodiments.

In various embodiments, various approaches are used to track the lengths $L_{1,t}$, $L_{2,t}$ in real time. For example, in some embodiments, an absolute rotation sensor (rotational position sensor) is included with the spool of each actuator assembly 104, 106. The rotation sensor can be integrated into the spool, and rotational positions of the spool and the diameter of the spool can be used to determine the amount of cable unwound from the spool. In other embodiments, the rotation sensor is provided on a gear, which interfaces with a gear fixed on the spool. The two gears mesh, such that as the spool rotates both gears also rotate. The numbers of teeth on the gears, the diameter of the spool, and the data from the position sensor can be used to determine the amount of cable unwound from the spool. The rotation sensor and/or the gear ratio may be configured to account for multiple turns of the spool. In some embodiments, multi-turn encoders, such as a potentiometers, can be included to facilitate determination of the lengths $L_{1,t}$, $L_{2,t}$ through multiple revolutions of the spools. A calibration routine may be executed by running the motors to fully wind and/or unwind the cables to help calibrate the rotation sensors.

In other embodiments, other tracking systems can be used to determine the position of the end effector 116 and the real-time geometry of the apparatus 100. For example, in some embodiments an optical tracking system (e.g., stereoscopic IR camera) can be used to track a position of a fiducial marker positioned on the end effector in real time. As another example, image-recognition and video processing may be used to track the geometry of the cables 108, 112 using real-time video of the apparatus 100.

Figure 4:
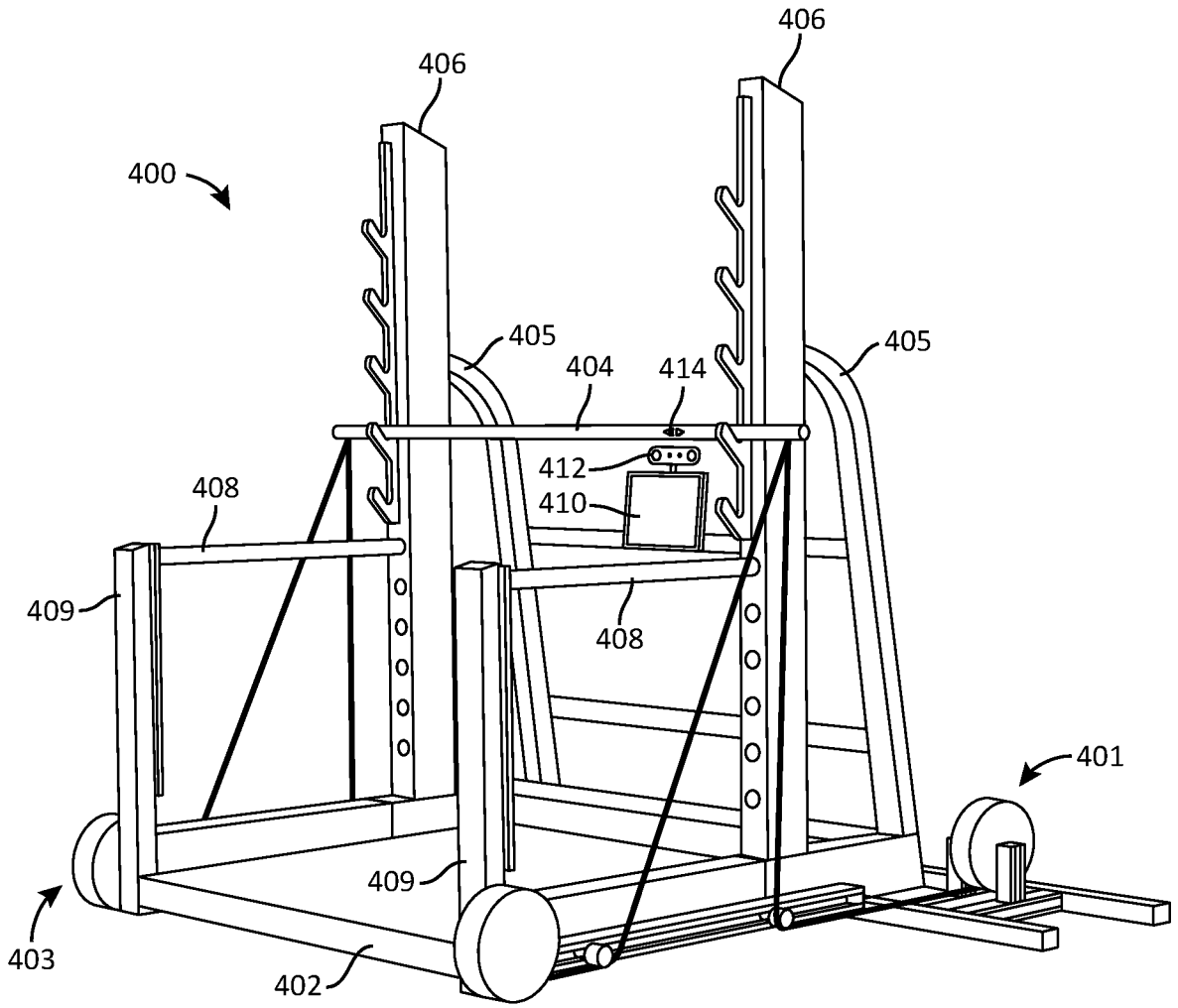
FIG. 4 is an illustration of a multi-cable strength training apparatus, according to an exemplary embodiment.

Referring now to FIG. 4, a perspective view of a multi-cable strength training apparatus 400 is shown, according to an exemplary embodiment. In the example shown, the multi-cable strength training apparatus 400 includes two dual-cable strength training apparatuses 100 (indicated as first dual-cable apparatus 401 and second dual-cable apparatus 403) arranged parallel to one another and separated by a platform 402. In the configuration shown, the end effectors 116 of the dual-cable apparatuses 100 are joined by a bar 404 shown in a position above the platform 402. The multi-cable strength training apparatus 400 is also shown as including a rack 405. In other embodiments, the rack 405 and/or the platform is omitted.

The rack 405 is provided between the first dual-cable apparatus 401 and the second dual-cable apparatus 403 and includes a pair of vertical posts 406 at a first edge of the platform 402. The vertical posts 406 are configured to receive and hold the bar 404 at one or more heights above the platform 402. The rack 405 may also include a pair of rails 408 that extend parallel to the beams 102 (perpendicular to the vertical posts 406) and which may be height-adjustable to facilitate various exercises. The rails 408 may be formed as cantilevered rails extending from the vertical posts 406 or as rails coupled to both the vertical posts 406 and rear supports 409 positioned opposite the vertical posts 406. The rails 408 are positioned between planes defined by the apparatuses 401, 403 and below the bar 404. The rails 408 may be selectively repositionable to various heights (e.g., manually, using an actuator) or selectively removed from the rack 405 to facilitate various exercises. The rack 405 is thereby configured to hold the bar 404 in various positions before and after strength-training exercises performed using the multi-cable strength training apparatus 400. The rack 405 is configured to withstand at least the maximum force that can be applied to the bar 404 by the dual-cable apparatuses 401, 403. The rack 405 facilitates the apparatus 400 in simulating traditional weight training if desired by the user as well as providing a convenient place for the user to rest the bar between exercises.

As shown, the bar 404 is provided as a linear rod (barbell attachment) that extends between the end effectors 116. In some embodiments, various attachments are provided which can be coupled to the bar 404 to facilitate different exercises. In some embodiments, the bar 404 is selectively replaceable with various attachments, for example handles, loop straps, rings, hex bars, ropes, non-linear shafts, harnesses, belts, vests, etc.. While the bar 404 is connected to both the first dual-cable apparatus 401 and the second dual-cable apparatus 403, in some embodiments the bar 404 is replaceable with a first attachment for the first dual-cable apparatus 401 and a second, separate attachment for the second dual-cable apparatus 403 to facilitate exercises using either a single dual-cable apparatus 401, 403 or using both dual-cable apparatuses 401, 403 without the user perceiving a mechanical connection therebetween.

As described above for the dual-cable apparatus 100 of FIGS. 1-3, the first dual-cable apparatus 401 and the second dual-cable apparatus 403 both includes a pair of cables and associated actuator assemblies to independently control the tension provided at each cable. When joined by the bar 404, the dual-cable apparatuses 401, 403 combine to provide four independently-controllable tensions that can be used to dynamically update a magnitude and direction of the force applied to the user at the bar 404.

In the embodiment shown, the multi-cable apparatus 400 includes a user interface device, shown as a display screen 410. In some embodiments, multiple display screens 410 may be included. The one or more display screens 410 are configured to provide a graphical user interface to communicate information relating to operation of the apparatus 400 to a user. A display screen 410 may also be configured as a touchscreen to receive input from the user in some embodiments. As shown, the display screen 410 is mounted on the rack 405. In other embodiments, the display screen 410 may be provided as a separate device. For example, in some embodiments, the apparatus 400 can communicate with a personal device of the user, for example a smartphone or a tablet, to provide a graphical user interface via relating to multi-cable apparatus 400 on the personal device of the user. Such communication may be direct wireless communication (e.g., Bluetooth, WiFi) between the apparatus 400 and the personal device, or indirectly via a cloud server in communication with both the personal device and the apparatus 400 via the Internet.

For example, the display screen 410 may be configured to display real-time data from the device sensors as well as critical information for a selected exercise or series of exercises. In some cases, the user can select a desired type of exercise movement, workout, or diagnostic measurement via a graphical user interface of the display screen 410. The display screen 410 can show a dashboard that provides real-time information and feedback relating to form, trajectory, velocity, force, range of motion, repetition count, targets, etc. for the user during the exercise. The display screen 410 may also be controlled to show coaching videos or alerts.

As shown in FIG. 4, buttons 414 may be included on the bar 404 or other attachment to allow a user to provide user input to the apparatus 400. The buttons 414 are positioned on the bar 404 such that a user can interact with the buttons while performing an exercise (e.g., to initiate an exercise, to apply the load to the cables, to increase or decrease a resistive force, to indicate the end of an exercise, to release the load from the cables), thereby providing intra-exercise load adjustments, improving safety for the user, and improving the user's impression of control over and trust of the apparatus 400. Buttons may also be provided elsewhere on the apparatus 400.

In some embodiments, buttons are provided with the display screen 410 for interaction with the display screen and the apparatus 400 between exercises. The buttons may be wirelessly communicable with a controller. Other input devices may be used in various embodiments. For example, a microphone may be used with speech-recognition processing to allow for voice control of the apparatus 400. In some embodiments, an external device such as a smartphone or tablet is communicable with the apparatus 400 and allows a user to input commands to the apparatus.

As shown in FIG. 4, the apparatus 400 is provided with a user tracking system. The user tracking system is shown as including the platform 402 and a camera system 412. The platform 402 and the camera system 412 are configured to provide information indicative of a position of the user relative to the apparatus 400, biomechanical alignment and dimensions of the user, and other data that can be used for control of the apparatus 400 and for providing feedback and/or post-workout reports to the user, a coach/trainer, and/or to a manager of a fitness facility.

The platform 402 may include a single continuous plate that the user stands on, or a split plate that includes two equally-sized plates (one for the left foot of the user and one for the right foot of the user). The plate or plates are provided with force sensors at the corners of the plate(s). The force sensors can determine the total load on the plate and the center of pressure on the plate, either overall in the single-plate embodiment or independently for each foot in the split plate embodiment. In other embodiments, the platform 402 is provided with a force sensing mat that includes load cells distributed throughout to provide force data exerted locally at a large number of positions on the platform 402. The force sensor measurements can be used by a controller to determine the stability of the user and how the user performs the exercise. For example, the data from the force sensors can be processed to detect loss of balance or compensatory motions, and may be used to trigger a release of a load for safety purposes or to provide feedback on form to a user or coach/trainer. As another example, the platform force sensor measurements can be used to track the position of a support polygon defined by positions of the user's feet can be used in control of the apparatus 400, for example to determine a direction of a force that can be applied without pulling the user off balance or that would give a sensation of a purely-vertical force to the user. In addition, the sensor data from the platform 402 can be used to measure performance in tasks such as jumping or other exercises.

The camera system 412 can be provide in addition to or in place of the force sensors in the platform 402. The camera system 412 is configured to capture or measure the user's motions and movements. The camera system 412 may be configured to determine the pose which consists of the user's joint angles for specific joints, such as the knee and hip, or the body shape, such as the curvature of the back. The camera system 412 can determine various other biomechanical dimensions, for example height, length of various body parts, etc. The camera system 412 may include a single RGB camera, several RGB cameras, or one or more infrared cameras. In embodiments with multiple cameras, the cameras may be provided in a stereoscopic arrangement and/or provided at various positions around the apparatus 400 to provide views of the user from multiple perspectives (e.g., a side view and a head-on view). In some embodiments, the camera system 412 is configured as an active system that emits its own light waves (e.g., infrared) and receives and interprets their reflections to generate tracking data (e.g., structured light systems, time-of-flight systems, LIDAR, etc.). In some embodiments, the camera system 412 is also configured to collect information regarding the position and geometry of the bar 404, end effectors 116, or cables of the apparatuses 100. Such information can be used in control of the apparatus 400. Data from the camera system 412 can be used to control the force vector applied by the apparatus 400 to improve strength training efficiency and safety, to provide real-time form correction feedback to a user (e.g., via display screen 410), and to produce post-exercise reports, videos, coaching tips, exercise programs, etc. to be provided to the user or coach. In some embodiments, the camera system 412 is used to collect user input for no-touch gesture control of a graphical user interface.

In some embodiments, the apparatus 400 includes other sensors to measure biometric data such as heart rate, heart rate variability, blood saturation (e.g., oxygen saturation level), respiration rate, etc. The apparatus 400 may also communicate with a fitness tracker device of a user (e.g., watch, wrist strap, chest strap) to wirelessly (e.g., via WiFi, Bluetooth, ANT+) obtain such data. Fitness tracker data may also include information such as sleep and fatigue measurements that can be used to customize a fitness program (e.g., to reduce loads on a user when fatigued or stressed, to increase loads when one or more indicators suggest that an exercise is not challenging a user, etc.).

Figure 5:
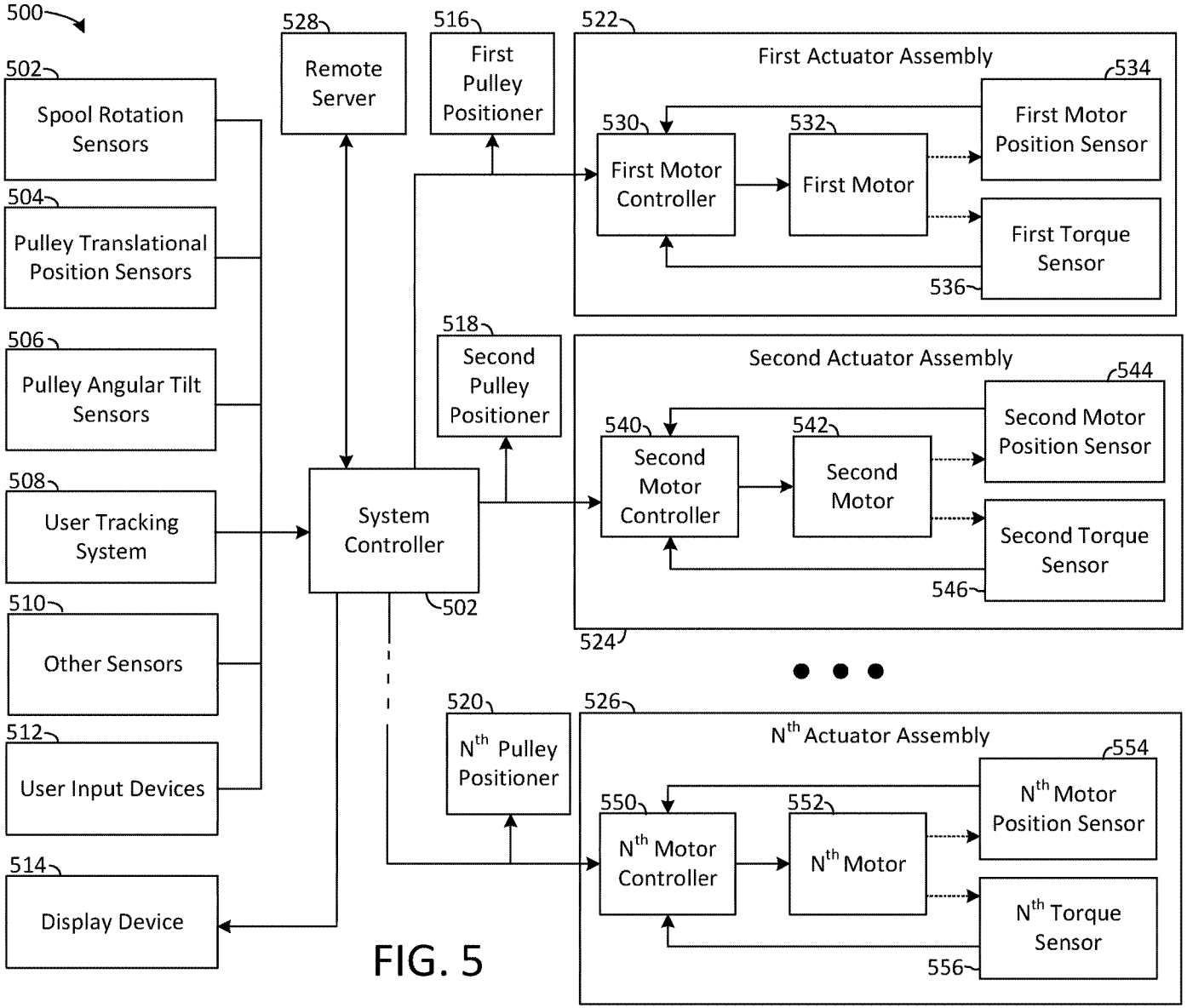
FIG. 5 is a block diagram of an electronic control system for a multi-cable strength training apparatus, according to an exemplary embodiment.

Referring now to FIG. 5, a block diagram of the electronic control system 500 of the multi-cable strength training apparatus 400 is shown, according to an exemplary embodiment. Although FIG. 4 shows a four-cable system, FIG. 5 shows a system that can control the tension in N cables associated with N independently-controllable actuator assemblies, where N can be any integer of two or more (e.g., 3, 4, 5, 6, 7, 8, etc.). In the embodiment of FIG. 4, N=4. In the embodiment of FIGS. 1-3, N=2.

The electronic control system 500 is shown as including a system controller 502 which receives input data from spool rotation sensors 503, pulley translational position sensors 504, pulley angular tilt sensors 506, user tracking system 508, other sensors 510, user input devices 512. The electronic control system 500 also includes a display device 514 communicable with the system controller 502. The electronic control system 500 is also shown to include a first pulley positioner 516, a second pulley positioner 518, etc., up to an $N^{th}$ pulley positioner 520, as well as a first actuator assembly 522, a second actuator assembly 524, etc., up to an $N^{th}$ actuator assembly 526. The system controller 502 is also shown as communicating with remote server 528.

The system controller 502 is configured to perform computing operations to process data from the spool rotation sensors 503, pulley translational position sensors 504, pulley angular tilt sensors 506, user tracking system 508, other sensors 510, and user input devices 512 to control signals (e.g., operating setpoints) for the first pulley positioner 516 through the $N^{th}$ pulley positioner 520 and the first actuator assembly 522 through the $N^{th}$ actuator assembly 526. The system controller 502 may include one or more processors and non-transitory computer readable media storing program instructions executable by the one or more processors to perform the various operations described herein. For example, the hardware and data processing components used to implement the system controller 502, other computing components and methods described herein may include a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, conventional processor, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. Controllers herein may include computer-readable media (e.g., memory, memory unit, storage device), which may include one or more devices (e.g., RAM, ROM, Flash memory, hard disk storage, EPROM, EEPROM, other optical disk storage, magnetic disk storage or other magnetic storage devices, any other medium which can be used to carry or store desired program code in the form of machine-executable instructions or data structures, combinations thereof) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The spool rotation sensors 503 are configured to provide data indicative of the lengths of cable unwound from spools of the actuator assemblies 522, 524, 526. For example, in some embodiments, an absolute rotation sensor (rotational position sensor) is included with the spool of each actuator assembly 522, 524, 526. The rotation sensor can be integrated into the spool, and rotational positions of the spool and the diameter of the spool can be used to determine the amount of cable unwound from the spool. In other embodiments, the rotation sensor is provided on a gear, which interfaces with a gear fixed on the spool. The two gears mesh, such that as the spool rotates both gears also rotate. The numbers of teeth on the gears, the diameter of the spool, and the data from the position sensor can be used to determine the amount of cable unwound from the spool. The rotation sensor and/or the gear ratio may be configured to account for multiple turns of the spool. In some embodiments, multi-turn encoders, such as a potentiometers, can be included to facilitate determination of the lengths of cable wound or unwound through multiple revolutions of the spools. The system controller 502 can control the actuators assemblies 522, 524, 526 to perform a calibration routine to fully wind and/or unwind the cables to help calibrate the rotation sensors. The system controller 502 is configured to process the data from the spool rotation sensors 503 for use in determining a real-time geometry of the multi-cable apparatus 400.

The pulley translational position sensors 504 are configured to provide data indicative of current translational positions of pulleys that engage the cables (e.g., the first pulley 110 and the second pulley 114 as in FIG. 1). The system 500 may include N pulley translational position sensors, such that data is provided indicative of the position at which each cable extends from multi-cable apparatus 400. The data provided by the pulley translational position sensors 504 can be used by the system controller 502 to determine base dimensions of triangles in the geometry described with reference to FIG. 3. The pulley angular tilt sensors 506 are configured to provided data indicative of the angular tilts of the pulleys, for example an angle about a longitudinal axis of the beam 102 in FIGS. 1-3 and/or relative to plane defined by the platform 402. The system controller 502 can use the data from the pulley angular tilt sensors 506 to determine an orientation of the plane defined by the triangular geometry described with reference to FIG. 3.

The user tracking system 508 can include, for example, the camera system 412 and/or the force sensors of the platform 402 described above with reference to FIG. 4. The user tracking system 508 may also include a user's fitness tracker device as described above. Accordingly, the user tracking system 508 is configured to provide data indicative of a user's position relative to the dual-cable apparatus 100 or the multi-cable apparatus 400. The user tracking system 508 may also provide other biometric data, video files, and/or other user-related data to the system controller 502.

Other sensors 510 can include heart rate monitors, respiration sensors, microphones, environmental sensors (e.g., temperature, humidity, or airflow sensors), among other possibilities, that can be integrated into or otherwise provided with the dual-cable apparatus 100 or the multi-cable apparatus 400. The other sensors 510 are configured to provide various data to the system controller 502, which can be configured to use such data for control, calibration, exercise customization, tracking device utilization, providing coaching feedback, etc.

User input devices 512 can include a switch, touchscreen, pedal, buttons (e.g., buttons 414), dials, microphone-based speech-recognition device, gesture-control camera systems, smartphone or tablet interfaces, smart watch interfaces, and/or various other devices configured to accept user input and communicate the user input to the system controller 502. The user input devices 512 can be physically integrated into the dual-cable apparatus 100 or the multi-cable apparatus 400 or may be provided separately and wireless communicable with the system controller 502 (e.g., via Bluetooth, WiFi, ANT+, near-field communication, consumer infrared (CIR) light-based communication, etc.). The user input devices 512 can be configured to provide various input to the system controller 502 to interact with the system controller 502 and, in some cases, a graphical user interface generated by the system controller 502 and provided via the display device 514. For example, the system controller 502 may be programmed to interpret a signal from a first button as instruction to increase a force output, a signal from a second button as an instruction to decrease a force output, and a signal from a third button as an instruction to release all force application. Various user interactions and input devices suitable for such interactions are contemplated by the present disclosure.

The display device 514 is configured to display information for communication to a user. In some embodiments, the display device 514 is an analog display, for example with LED lights that are controlled to indicate system status, a number of repetitions performed, an exercise duration, a magnitude and/or direction of a resistive force generated by the apparatus, etc. In other embodiments, the display device 514 is a digital display screen configured to display a graphical user interface generated by the system controller 502. For example the display device 514 may be the display screen 410 described above with reference to FIG. 4. In some embodiments, the display device 514 is a user's personal computing device (e.g., smartphone, tablet, laptop, desktop, watch), which may have a mobile application installed thereon to facilitate interaction between the system controller 502 and the personal computing device. In some cases, the display device 514 includes a speaker configured to emit audible alerts.

The system controller 502 is also shown as communicating with remote server 528. The remote server 528 can provide various exercise programs, control logic, workout regimens, pre-recorded instructional videos, live exercise classes, or other content, for guiding operation and use of the system 500. The remote server 528 may store user profiles that can be used to customize operation of the system controller for a particular user, i.e., by retrieving the profile for that user when the user initiates the system 500. The system controller 502 can also upload data to the remote server 528 during or following performance of exercises. For example, the system controller 502 can transmit data to the remote server 528 associated with a particular user profile to allow a user or coach to track the exercises completed by the user (e.g., to see progress or cumulative work over time) and to support gamification features. In some embodiments, a score is generated at the system controller 502 or the remote server 528 based on the user's form, exercise trajectory, velocity, force applied, work done, etc. and used to enable gamification features, track progress towards goals or change over time, create competitions between users. In some embodiments, the remoter server 528 may communicate with a social media platform via an application programming interface to allow an athlete to share their workout data on the social media platform. In some embodiments, the remote server 528 is configured to provide longitudinal tracking and analysis of the exercise data, for example using machine learning algorithms or artificial intelligence development. The remote server 528 can analyze the data to provide insights about user strength asymmetries or deficits, potential injury concerns (e.g., preventative alerts), and enhanced workout program suggestions based on the user's history, current health status, or comparison to similar users. Comprehensive analysis of the exercise data collected can be used for individualized prescriptions using digital coaching.

Data may also be uploaded and automatically processed to inform maintenance and service operations (e.g., fault prediction and diagnostics), provide usage statistics for gym managers, and otherwise facilitate advanced analytics that may be valuable to various parties. For example, the remote server 528 can be programmed to create different dashboards for various users, for example for athletes, coaches, rehab therapists, clinical researchers, insurance providers, software developers, or gym managers.

The system controller 502 is configured to receive inputs from the remote server 528 and the various sensors 503-512, and generate control signals for at least the first actuator assembly 522, the second actuator assembly 524, through the $N^{th}$ actuator assembly 526 (in relevant embodiments). The control signals may include operating setpoints for the actuator assemblies 522-526 (i.e., N different operating setpoints for the N different actuator assemblies). In some embodiments, each operating setpoint corresponds to a torque setpoint, i.e., a value of torque (e.g., units of Newton-meters) to be provided by the corresponding actuator assembly. In such embodiments, the system controller 502 provides an actuator assembly with the operating setpoint to command the corresponding actuator assembly to provide the corresponding amount of torque. The system controller 502 can determine different operating setpoints for the different actuator assemblies 522-526, such that the different actuator assemblies can be commanded to provide different torques. Furthermore, the system controller 502 can dynamically update the operating setpoints in real-time, such that the operating setpoints provided to the actuator assemblies 522-526 can change nearly instantaneously in response to data from the various sensors and/or logic of a particular exercise program being executed. Various process for generating these operating setpoints are shown in FIGS. 6-10 and described in detail with reference thereto.

As shown in FIG. 5, the first actuator assembly 522 is shown to include a first motor controller 530, a first motor 532, a first motor position sensor 534, and a first torque sensor 536. The second actuator assembly 524 is shown to include a second motor controller 540, a second motor 542, a second motor position sensor 544, and a second torque sensor 546. The $N^{th}$ actuator assembly 526 is shown to include an $N^{th}$ motor controller 550, an $N^{th}$ motor 552, an $N^{th}$ motor position sensor 554, and an $N^{th}$ torque sensor 556. The following description of the first motor controller 530, a first motor 532, a first motor position sensor 534, and a first torque sensor 536 can be extended to the analogous components of the second actuator assembly 524 through the $N^{th}$ actuator assembly 526.

The first motor controller 530 is configured to receive the operating setpoint from the system controller 502 and control the first motor 532 in accordance with the operating setpoint. For example, if the operating setpoint indicates an amount of torque to be provided by the first motor 532, the first motor controller 530 controls the first motor 532 to drive the actual amount of torque provided by the first motor 532 to the setpoint amount of torque. Because highly accurate control of tension in the cables is a key feature for enabling the apparatuses described herein, the various following features are provided to improve the ability of the first motor 532 to accurately track the operating setpoint provided by the system controller 502.

The first motor 532 may be a, a permanent magnet brushless direct current (PMBLDC) motor suitable for high torque and low speed operation. A PMBLDC motor has three phases and use a motor driver (amplifier) to push current through a combination of the phases depending on the angular position of the rotor of the motor. In general, the first motor may have the property that the output torque provided is generally proportional to the current going through the active phases of the motor. However, for smooth and accurate operation of the first motor 532, an accurate determination of the current rotational angle of the motor is needed to determine how to excite the different phases of the motor.

Accordingly, in the embodiment shown, the first actuator assembly 522 includes the first motor position sensor 534 which is configured to measure the rotational position of the first motor 532 and provide the data to the first motor controller 530. The first motor position sensor 534 may configured to provide an absolute position in order to be used for a pre-computed compensation algorithm without use of a homing procedure. In other embodiments, in lieu of an absolute position, the first motor position sensor 534 may provide incremental position and an index signal which occurs at a specific position once per revolution. At least one full revolution can be measured in a calibration procedure to facilitate this type of sensor in providing an absolute rotation angle. In some embodiments, the first motor position sensor 534 is also used in place of the spool rotation sensor 503 to determine an amount of cable wound/unwound from the spool attached to the first motor 530. For example, a homing routine can be used to train/calibrate an algorithm for calculating a length of cable based on data from the first motor position sensor 534.

In some embodiments, open loop control of the torque provided by the first motor 532 is executed by the first motor controller 530. In such embodiments, the first motor controller 530 uses the operating setpoint, the motor position data, and known parameters of the first motor 532 to provide current to the phases of the PMBLDC first motor 532 pre-associated with predicted/estimated torque values. In such embodiments, adjustments can be made for known or estimated resistance in gears (e.g., in some embodiments, a gearbox is provided between the first motor 532 and a spool/drum that connects to the cable), pulleys, friction in bearings, etc. For example, the relationship between current and the resulting cable tension can be complicated by factors including cogging torque of the motor, friction in the bearings, friction in any gears, and mutual reluctance torque. These factors can be at least partially canceled through a compensation algorithm executed by the first motor controller 530. For example, an anti-cogging compensation algorithm can be executed, because cogging torque may be the most significant factor here. The first motor controller 530 can train a compensation algorithm by moving the motor extremely slowly through a full mechanical revolution in both directions and measuring the current, as a function of position, it takes to perform this motion. In operation, this current can then be added to any calculated current based on the required torque of the motor to adjust the current to compensate for the resistance.

To further improve the accuracy of the actual torque of the first motor 532, in some embodiments the first actuator assembly 522 includes a torque sensor 536 that provides measurements used for closed-loop feedback control by the first motor controller 532 as shown in FIG. 5. The torque sensor 536 measures the actual torque generated by the first motor 532. In some embodiments, the torque sensor 536 is provided as an inline torque sensing element. In such embodiments, the motor 532 is coupled to the inline torque sensing element that is then coupled to the spool/drum that connects to the cable, such that the torque of the motor is experienced by the torque sensor 536 between the motor and the spool/drum. The torque sensor 536 may be a load cell configured for measuring torque or a mechanical element, such as a spring, that has a known deformation response to forces, or torques, applied to it paired with a sensor for measuring the deformation of the spring.

In other embodiments, the torque sensor 536 measures the reaction torque it takes to keep the frame of the motor from spinning. According to Newton's third law, action of the motor producing torque on the spool (i.e., tension in the cable) must have an equal and opposite reaction torque on the frame of the motor. Thus, the torque sensor 536 may be configured and positioned at a frame of the motor to measure the torque required to keep the frame of the motor 532 from spinning in order to measure the torque generated by the motor 532.

The torque measurements can then be used for feedback control of the first motor 532. Various feedback control algorithms are contemplated by the present disclosure. For example, the first motor controller 530 could use a proportional, proportional-integral or proportional-integral-derivative approach to generating currents that drive the actual, measured torque values to a torque setpoint provided by the system controller 502. In other embodiments, the tension in the cable connected to the first motor 532 is directly measured by a sensor embedded in the cable or positioned at the end effector. The tension could then be used by the first motor controller 530 in feedback control of the first motor 532.

The second actuator assembly 524 through the $N^{th}$ actuator assembly 526 may be configured as described for the first actuator assembly 522. Accordingly, the electronic control system 500 provides a distributed control system for generating different, highly-accurate torques at multiple motors in accordance with a unified control determined by the system controller 502. The electronic control system 500 thereby facilitates the creation of smooth, accurate, quickly-adapting force profiles which are not possible with traditional resistance systems. The process shown in FIGS. 6-10 can be executed by the electronic control system 500 to provide a variety of advantageous exercises to a user which could not be achieved with traditional resistance systems.

Figure 6:
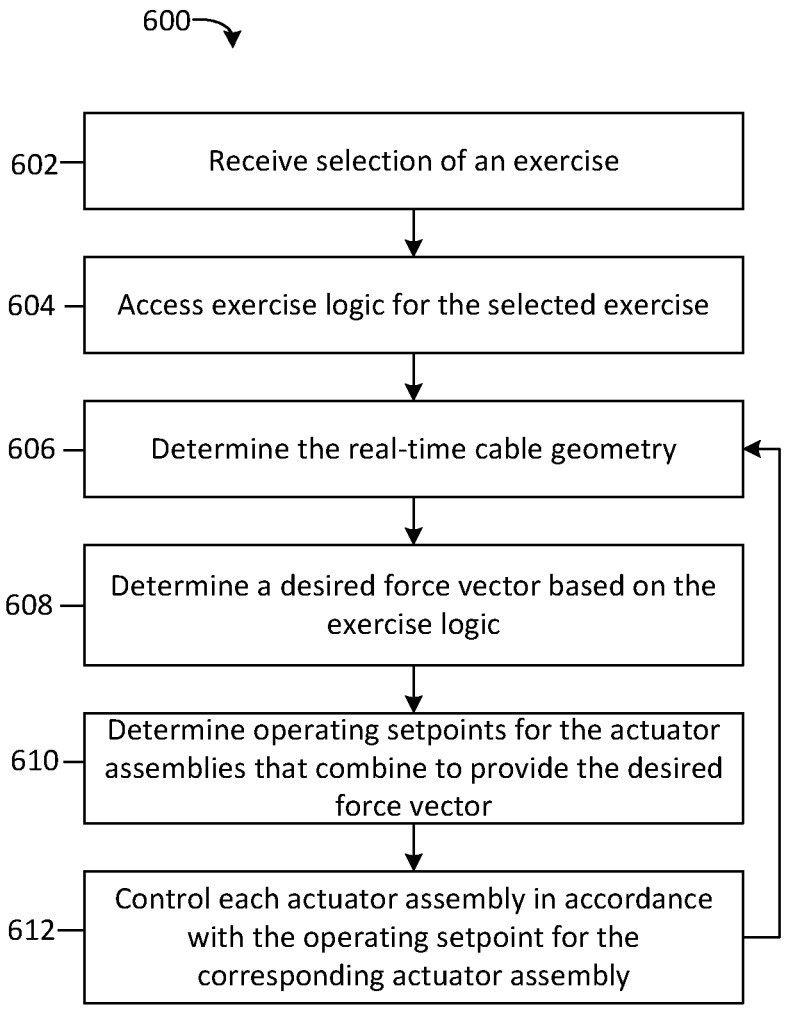
FIG. 6 is a flowchart of a process of providing exercise programs to a user using the dual-cable strength training apparatus of FIG. 1, the multi-cable strength training apparatus of FIG. 4, and/or the electronic control system of FIG. 5, according to an exemplary embodiment.

Referring now to FIG. 6, a flowchart of a process 600 for providing exercise programs to a user using the dual-cable strength training apparatus 100, the multi-cable strength training apparatus 400, and/or the electronic control system 500 is shown according to an exemplary embodiment. The process 600 can be executed by the system controller 502 of the control system of FIG. 5.

At step 602, a selection of an exercise is received at the system controller 502. For example, a user may select a particular exercise (e.g., squat, lunge, shoulder press, curls, etc.) from a set of available exercises via a graphical user interface. As another example, a user may select a workout program that includes a series of exercises for the user to complete in sequence. In such an example, a current exercise in the series of exercises is determined at step 602. Selection of the exercise may include selection of an amount of simulated weight/force to be provide, a number of reps, a number of sets, or some other parameter of the exercise.

At step 604, exercise logic for the selected exercise is accessed. The exercise logic provides computer code providing instructions executable by the system controller 502 to generate operating setpoints for the actuator assemblies in order to generate a dynamic force vector suitable for the selected exercise. In some embodiments, the system controller 502 includes a memory device that stores exercise logic for a full library of selectable exercises. In other embodiments, the system controller 502 can access the remote server 528 to retrieve exercise logic therefrom for the selected exercise. A combination of storage options is possible, for example to store frequently-used exercise logic locally at the system controller 502 while new or rarely-used exercise logic is available on the remote server 528.

At step 606, the real-time cable geometry is determined for all cables used in the selected exercise. For example, the lengths of the sides of the triangles shown in FIG. 3 and described in detail with reference thereto may be determined at step 606. Step 606 may result in providing real-time tracking of the position of the end effector 116 or of the bar 404 joining a pair of end effectors 116 as may be applicable in various embodiments. Step 606 can be performed based on the rotational sensor position measurements described above. By tracking the geometry over time, the velocity and acceleration of various components (e.g., of the end effector 116) can be determined. In some embodiments, step 606 includes tracking a user's position based on data from the user tracking system.

At step 608, a desired force vector is determined based on the exercise logic. Depending on the exercise logic, the desired force vector may be determined as a function of the real-time cable geometry, the user's position, time (e.g., a duration since the beginning of the exercise), random perturbations, or any of the various other data described herein. The desired force vector includes a magnitude and a direction of the force to be provided an end effector (or attachment thereto) and experienced by the user while performing the selected exercise.

At step 610, operating setpoints are determined for the multiple actuator assemblies that are calculated to cause operation of the actuator assemblies to combine to provide the desired force vector. For example, the operating setpoints may be torque setpoints for motors of the actuator assemblies. As another example, the operating setpoints may be tension setpoints for each of the cables. Executing step 610 may include performing computations based on the real-time cable geometry and constraints that ensure solutions do not violate physical constraints/limitations of the system. In some embodiments, step 610 includes determining an optimal set of operating setpoints from multiple possible solutions to providing the desired force vector.

At step 612, each actuator assembly is controlled in accordance with the operating setpoint for the corresponding actuator assembly determined at step 610. For example, the operating setpoints can be distributed from the system controller 502 to multiple motor controllers 530, 540, 550, which can then control corresponding motors 532, 542, 552 as described above with reference to FIG. 5. An actual, resulting force is thereby caused to be exerted on the user at the end effector which substantially matches the desired force vector determined at step 608.

The process 600 can repeatedly cycle any or all of steps 606-612 to provide high-frequency updates to the resulting force exerted on the user. The process 600 is adaptable for various exercises, for various users, and for various physical layouts and arrangements of the force-application hardware described herein. FIGS. 7-10 illustrate processes that can be used in conjunction with the process 600 of FIG. 6 (e.g., as sub-parts of the process 600) to provide different types of workouts having different force profiles which are not possible with traditional weight systems.

Figure 7:
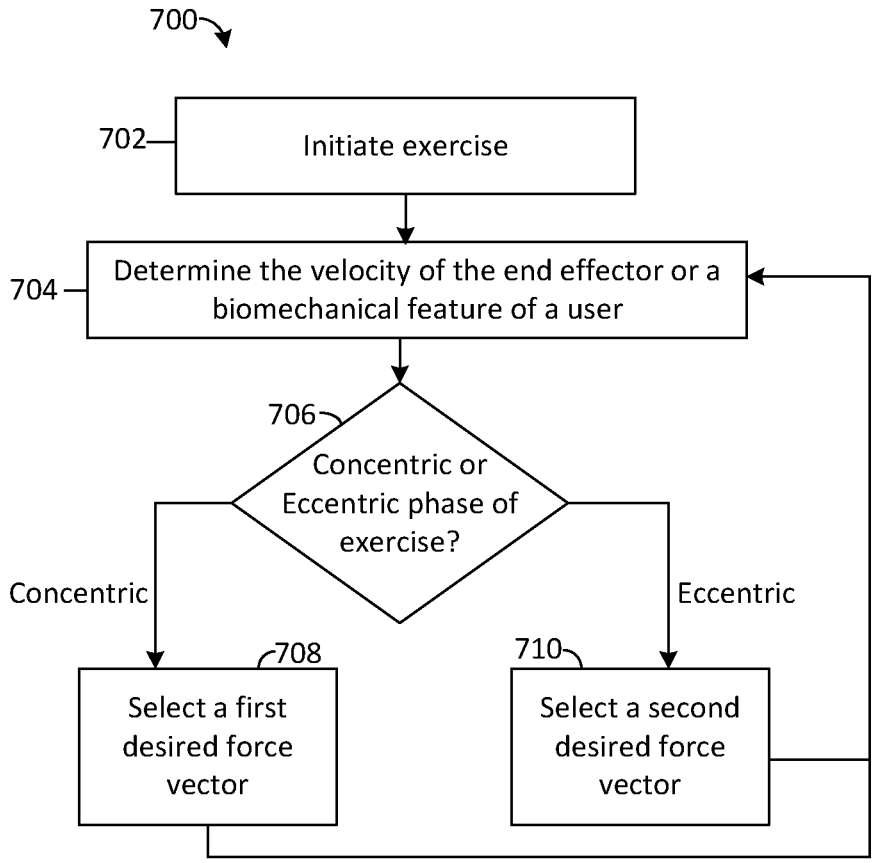
FIG. 7 is a flowchart of providing a first exercise program using the dual-cable strength training apparatus of FIG. 1, the multi-cable strength training apparatus of FIG. 4, and/or the electronic control system of FIG. 5, according to an exemplary embodiment.

Referring now to FIG. 7, a flowchart of a process 700 for providing a different forces in different phases of an exercise using the system described herein is shown, according to an exemplary embodiment. In process 700, the exercise is initiated at step 702 (e.g., as part of process 600). At step 704, in some embodiments, a velocity of the end effector of the apparatus 100 or 400 is determined, for example based on the real-time geometry determined at step 606. In other embodiments, a biomechanical feature (e.g., a joint, a joint angle, a facial feature) of a user is tracked by a user tracking system and a velocity thereof is determined. At step 705, a determination is made using the tracked velocity of whether the user is currently in a concentric or eccentric phase of the exercise. The determination may be based on logic in the exercise logic defined based on expected movements for a selected exercise. For example, in a given coordinate system, upward velocities may be associated with a concentric phase and negative velocities may be associated with an eccentric phase (or vice versa depending on the selected exercise). As shown in FIG. 7, the desired force vector can be selected to be different for the two phases. In particular, if a concentric phase is determined, a first desired force vector can be used at step 708. If an eccentric phase is determined, a second desired force vector can be used at step 710. The first desired force vector can differ from the second desired force vector in direction, magnitude, or both. As multiple repetitions are performed, the process 700 can cycle through steps 704-710 to alternate application of the first and second forces to a user. Process 700 thereby provides the ability to provide forces suitable to individual phases of a workout (e.g., a heavier load in a downward phase of a squat) which cannot be achieved with traditional free-weight or cable machine systems.

Figure 8:
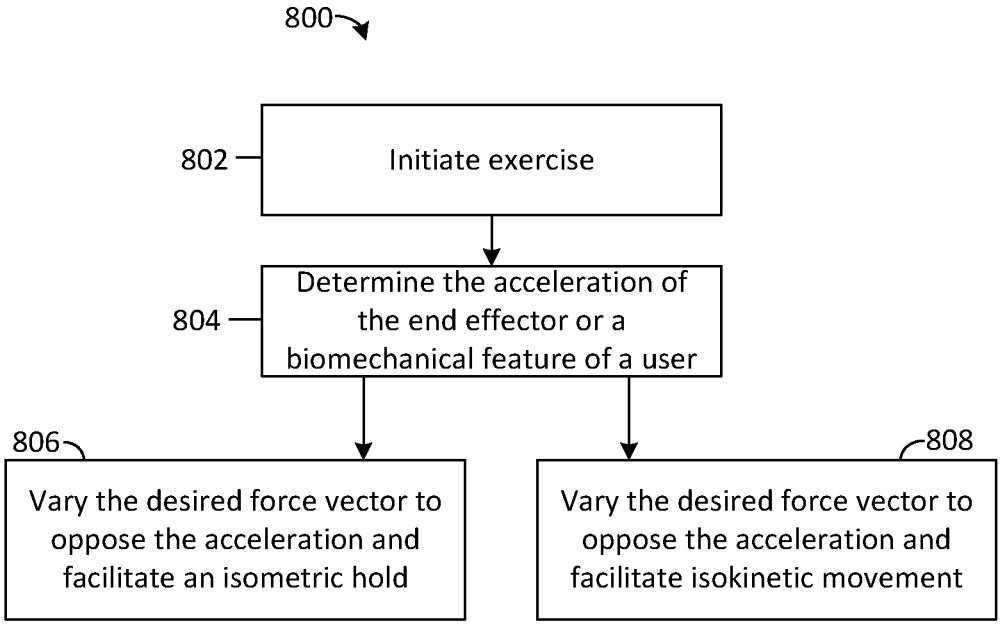
FIG. 8 is a flowchart of providing a second exercise program using the dual-cable strength training apparatus of FIG. 1, the multi-cable strength training apparatus of FIG. 4, and/or the electronic control system of FIG. 5, according to an exemplary embodiment.

Referring now to FIG. 8, a flowchart of a process 800 for providing isokinetic or isometric exercises using the systems and apparatuses described herein, according to an exemplary embodiment. At step 802, the exercise is initiated, for example as part of process 600. At step 804, in some embodiments the acceleration (i.e., a magnitude and direction of the change in the change in position over time) of the end effector of the apparatus 100 or 400 is determined, for example based on the real-time geometry determined at step 606. In other embodiments, the acceleration of a biomechanical feature of a user is determined based on data from the user tracking system. In both an isokinetic (constant velocity) and isometric (zero velocity) exercise, the acceleration is held to zero. This can be achieved by updating the force to resist any acceleration by the user, thereby providing an inertial effect. Accordingly, at step 806, if an isometric exercise is selected (i.e., an exercise in which variable force is used to maintain constant position), the desired force vector may be calculated to resist the acceleration to facilitate constant position of the end effector or the biomechanical feature to drive the user into an isometric hold. For example, this could be used to keep the user in a squat at a desired joint angle while resisting upward movements of the user to resist the temptation to come up out of the squat. Alternatively, at step 808, the desired force vector can be updated to resist the acceleration to drive the user into an isokinetic movement. Various strength training, rehabilitative, or form-coaching applications can be implemented using process 800.

Figure 9:
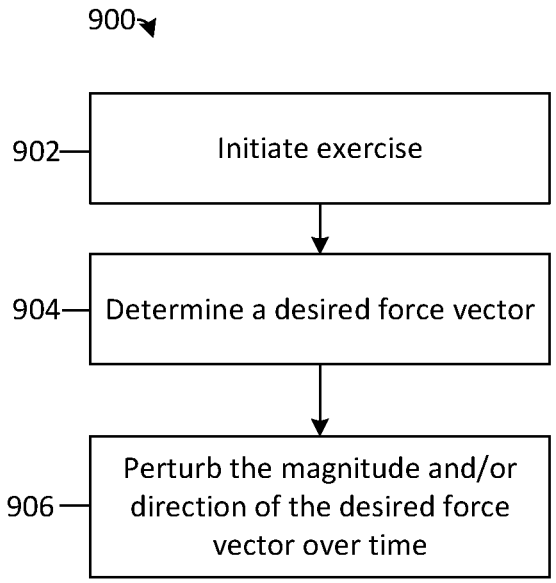
FIG. 9 is a flowchart of providing a third exercise program using the dual-cable strength training apparatus of FIG. 1, the multi-cable strength training apparatus of FIG. 4, and/or the electronic control system of FIG. 5, according to an exemplary embodiment.

Referring now to FIG. 9, a process 900 of providing force perturbations during an exercise using the systems and apparatuses described herein is shown, according to an exemplary embodiment. At step 902, the exercise is initiated, for example as part of process 600. At step 904, a desired force vector is determined, for example according to any of the various examples provided herein. At step 906, the magnitude, direction, or both of the force vector is perturbed over time, i.e., made to vary slightly from the original vector. For example, random variations of the force vector can be provided, for example by multiplying components of the force vector by one plus a small random variable. As another example, the perturbations can be regular, periodic, sinusoidal, or otherwise designed to achieve a physiological benefit for a user experiences the perturbed force. Exercises involving such perturbations may improve a user's balance, tendon and ligament health, neurological coordination, stabilizing muscle strength. Thus, controlled perturbations can be optimized for safe rehabilitative and injury-prevention exercises.

Figure 10:
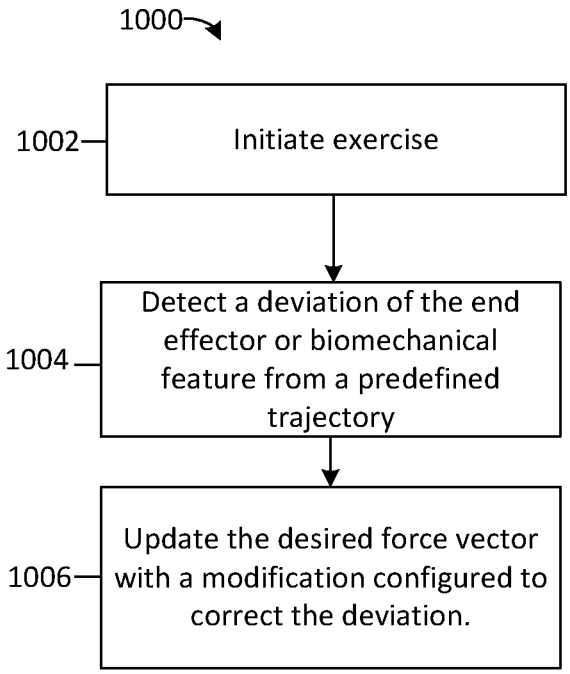
FIG. 10 is a flowchart of providing a fourth exercise program using the dual-cable strength training apparatus of FIG. 1, the multi-cable strength training apparatus of FIG. 4, and/or the electronic control system of FIG. 5, according to an exemplary embodiment.

Referring now to FIG. 10, a process 1000 for providing force feedback to a user to correct the user's deviation from a predefined trajectory. At step 1002, the exercise is initiated, for example as part of process 600. At step 1004, a deviation of the end effector or a biomechanical feature from a predefined trajectory is detected. The predefined trajectory may be defined for a particular type of work. For example, proper form, posture, biomechanics, etc. may be important to safe and effective execution of various exercises. Exercise logic for a selected exercise may include a predefined trajectory for a workout that matches the preferred, proper form for executing the exercise. In some embodiments, the predefined trajectory is customized for a particular user (e.g., based on the user's height, etc.). The predefined trajectory can defined acceptable or unacceptable positions for the end effector and/or for a tracked biomechanical feature of the user. A deviation is detected at step 1004 when the tracked position moves off of or outside of the predefined trajectory. At step 1006, the desired force vector is updated with a modification configured to correct the deviation. For example, in some embodiments, the modification results in a force component that pulls the user back into alignment with the predefined trajectory. As another example, the modification may result in a force that resists continuation of the exercise unless the user corrects to the realign with the predefined trajectory. Physical guidance to facilitate proper form and safe biomechanics can thus be provided by execution of process 1000. In some embodiments, audible alerts or graphical explanations indicative of how to achieve the predefined trajectory may be provided via the display device 514.

The apparatuses, control systems, and methods described herein are thereby configured to provide highly adaptable strength-training exercises. The strength training exercises can both simulate traditional weight training exercises and provide force profiles not possible with traditional weight training exercises. The ability to control the force vector can be used for new types of exercise protocols and enables intra-set and intra-rep optimization. For example, the force applied can change nearly instantaneously according to any arbitrary or programmed logic. This method enables force profiles that are static or dynamic (changing with position or time or various other factors). Exercise under the new, dynamic force profiles can cause users to recruit additional muscles that are not typically used in traditional exercises and strengthen tissues that may be neglected by traditional exercises. The disclosure above also outlines various data and analytics that can be generated as disclosed herein and used for content sharing, creation, and customization, coaching analytics, maintenance and service optimization, and facilities management. Furthermore, the apparatuses described herein may have a smaller physical footprint and fewer discrete components (e.g., separate weighted plates, etc.) as compared to traditional systems, providing space-saving advantages in both commercial, health care, and residential settings. These and various other advantages are provided by the teachings of the present disclosure.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the apparatuses 100, 400 and the system 500 as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein.

What is claimed is:

1. An apparatus comprising:

a first cable;

a first motor configured to provide first tension to the first cable;

a second cable coupled to the first cable at an end effector;

a second motor configured to provide second tension to the second cable;

a rail;

a first rotating member engaging the first cable and defining a location at which the first cable extends from the rail, wherein the first rotating member is repositionable along the rail; and an actuator controllable to reposition the first rotating member along the rail;

wherein the first cable and the second cable are routed such that the first tension and the second tension combine to provide a force on the end effector, wherein at least one of the first tension or the second tension is directed at least partially in a downward direction.

2. The apparatus of claim 1, further comprising a first torque sensor configured to measure an actual torque generated by the first motor and a second torque sensor configured to measure an actual torque generated by the second motor; and one or more controllers configured to control the first motor based on the actual torque generated by the first motor and the actual torque generated by the second motor.

3. The apparatus of claim 2, wherein the one or more controllers are configured to control the first motor and the second motor based on a target force vector to be experienced at the end effector.

4. The apparatus of claim 1, further comprising a control system programmed to control the first motor and the second motor based on a target direction for the force on the end effector.

5. The apparatus of claim 4, wherein the control system is further programmed to vary the target direction during performance of an exercise.

6. The apparatus of claim 1, further comprising a control system programmed to control the first motor and the second motor based on a target magnitude for the force on the end effector.

7. An apparatus, comprising:

a first cable;

a first motor configured to provide first tension to the first cable;

a second cable coupled to the first cable at an end effector;

a second motor configured to provide second tension to the second cable; and a controller configured to control the first motor based on one or more dimensions of a polygon having a first side defined by the first cable and a second side defined by the second cable;

wherein the first cable and the second cable are routed such that the first tension and the second tension combine to provide a force on the end effector, wherein at least one of the first tension or the second tension is directed at least partially in a downward direction.

8. The apparatus of claim 7, further comprising:

a rail; and a first rotating member engaging the first cable and defining a location at which the first cable extends from the rail;

wherein the first rotating member is repositionable along the rail.

9. The apparatus of claim 8, further comprising an actuator controllable to reposition the first rotating member along the rail.

10. A strength training apparatus, comprising:

an end effector configured to be engaged by a user;

a plurality of cables extending from the end effector; and a plurality of motors coupled to the plurality of cables, wherein each motor is independently controllable to provide a variable tension to a corresponding cable of the plurality of cables as a function of an operating setpoint for the motor, one or more of the variable tensions directed at least partially in an upwards direction;

circuitry programmed to control the plurality of motors based on one or more dimensions of a polygon having sides defined by a first cable and a second cable of the plurality of cables.

11. The strength training apparatus of claim 10, wherein the circuitry is programmed to generate the operating setpoints for the plurality of motors based on a target direction for a force on the end effector resulting from the variable tensions in the plurality of cables.

12. The strength training apparatus of claim 11, wherein the circuitry is further programmed to select the target direction based on a type of exercise for performance by the user.

13. The strength training apparatus of claim 10, wherein the circuitry is programmed to generate the operating setpoints for the plurality of motors based on a target magnitude for a force on the end effector resulting from the variable tensions in the plurality of cables.

14. The strength training apparatus of claim 10, wherein the circuitry is programmed to control the plurality of motors based on exercise logic associated with a workout selected by the user.

15. The strength training apparatus of claim 14, wherein the exercise logic indicates a dynamic resistive force to be experienced at the end effector by the user.

16. A method of varying a dynamic resistive force during a strength training exercise, comprising:

generating, based on a one or more dimensions of a polygon having sides defined by a plurality of cables coupled to an end effector, setpoints for a plurality of motors coupled to the plurality of cables; and exerting the dynamic resistive force at the end effector by controlling the plurality of motors in accordance with the setpoints.

17. The method of claim 16, wherein generating the setpoints is further based on logic associated with a selected exercise or workout.

18. The method of claim 16, wherein generating the setpoints comprises determining a target direction for the dynamic resistive force.

19. The method of claim 16, wherein the dynamic resistive force is configured to have different magnitude or direction in an eccentric phase of the strength training exercise compared to a concentric phase of the strength training exercise.

20. The method of claim 16, wherein exerting the dynamic resistive force comprises performing feedback control of at least one of the plurality of motors using a torque setpoint and a torque measurement or controlling at least one of the plurality of motors based in part on a measurement of at least one of the plurality of cables.

* * * * *